US008757910B2

(12) United States Patent
Kayser et al.

(10) Patent No.: US 8,757,910 B2
(45) Date of Patent: Jun. 24, 2014

(54) PRINTER MOUNTING ARRANGEMENT FOR FEED GUIDE MECHANISMS

(75) Inventors: David E. Kayser, Middlebury, CT (US); Victor C. Riccardi, Stamford, CT (US); Richard A. Sloan, Jr., Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 1073 days.

(21) Appl. No.: 12/639,146

(22) Filed: Dec. 16, 2009

(65) Prior Publication Data

US 2011/0052302 A1 Mar. 3, 2011

Related U.S. Application Data

(60) Provisional application No. 61/238,203, filed on Aug. 30, 2009.

(51) Int. Cl.
*B41J 7/24* (2006.01)
*B41J 13/00* (2006.01)

(52) U.S. Cl.
CPC ..... *B41J 13/00* (2013.01)
USPC ..... 400/645.3; 400/645.2

(58) Field of Classification Search
USPC ..... 400/642, 645.3, 645.4
See application file for complete search history.

(56) References Cited

U.S. PATENT DOCUMENTS 3,766,925 A * 10/1973 Rubricius ..... 606/120
5,271,586 A * 12/1993 Schmidt ..... 248/58
6,433,808 B1 * 8/2002 Kershner et al. ..... 347/215
6,585,465 B1 * 7/2003 Hammond et al. ..... 410/104
6,827,531 B2 * 12/2004 Womack et al. ..... 410/104
6,846,140 B2 * 1/2005 Anderson et al. ..... 410/104
2005/0002721 A1 * 1/2005 Koyabu ..... 400/613
2006/0239763 A1 * 10/2006 Lee ..... 402/79
2007/0063425 A1 * 3/2007 Tsujinishi ..... 271/145
2007/0138737 A1 * 6/2007 Yamada ..... 271/171
2007/0210046 A1 * 9/2007 Lai ..... 219/121.78
2008/0302742 A1 * 12/2008 Fulmer ..... 211/59.4
2009/0114758 A1 * 5/2009 Yamada ..... 242/566

FOREIGN PATENT DOCUMENTS

JP 08040573 A * 2/1996 ..... B65H 1/04
JP 08146585 A * 6/1996 ..... G03D 3/08
JP 2008065032 A * 3/2008

* cited by examiner

*Primary Examiner* — David Banh
(74) *Attorney, Agent, or Firm* — Steven J. Shapiro; Charles R. Malandra, Jr.

(57) ABSTRACT

A printer having a printer deck and a media support mechanism having a flexible biased mount is provided. In one configuration, the media support mechanism includes an adjustable side guide that is mounted in a biased clamp mechanism. The biased clamp mechanism includes opposing clamps arranged in the same plane that each have two portions with at least one biased toward the other portion. Each opposing clamp includes a top portion and a bottom portion fixed to the printer deck by a shoulder bolt wherein the bottom portion engages a coil spring and is spring biased from the deck toward the top portion of the clamp to engage the mounting portion of the side guide. The coil springs are selected to apply sufficient force to facilitate holding the side guide sufficiently in place during operation and to also allow a reasonable force to adjust the width of the side guide.

14 Claims, 4 Drawing Sheets

PRINTER MOUNTING ARRANGEMENT FOR FEED GUIDE MECHANISMS

CROSS REFERENCE TO RELATED APPLICATIONS

This application claims priority under 35 U.S.C. section 119(e) from Provisional Patent Application Ser. No. 61/238,203, filed Aug. 30, 2009, entitled Printer Mounting Arrangement For Feed Guide Mechanisms, by David E. Kayser, et al., which is incorporated herein by reference in its entirety.

TECHNICAL FIELD

The illustrative embodiments of the present invention relate generally to print feed mechanisms and, more particularly, to a new and useful mounting arrangement for an adjustable side guide that facilitates rapid adjustment of media sizes in a variable media size printing apparatus.

BACKGROUND

Certain specific purpose printers have been developed including many different printers dedicated to printing envelopes and postcards such as by expeditiously applying addresses and other messages to the envelope in batches of transactional mail or direct mail advertisements. Print feed mechanisms are often adjustable to facilitate the use of variable media sizes such as different sized envelopes and post cards.

One product line of successful envelope printers is the DA70s/DA75s color shuttle head addressing printer systems available from Pitney Bowes Inc. of Stamford Conn. In such a system, an adjustable side guide has typically been provided to support a stack of media and that often must be reconfigured several times per day when used to process different batches of different sized envelopes or postcards. Previously, the adjustment of the side guide in the opposed fixed mounting clamps has been time consuming.

Inasmuch as such a printer with a plurality of adjustable side guides is utilized to process batches of media (envelopes or postcards) of different sizes, faster replacement and adjustment of the side guide would allow faster job setup and therefore greater throughput. Accordingly, there is a need for an improved side guide mount clamp to facilitate more expeditious batch print job setup.

BRIEF DESCRIPTION OF THE DRAWINGS

The accompanying drawings show illustrative embodiments of the invention and, together with the general description given above and the detailed description given below serve to explain certain principles of the invention. As shown throughout the drawings, like reference numerals designate like or corresponding parts.

SUMMARY

Figure 1:
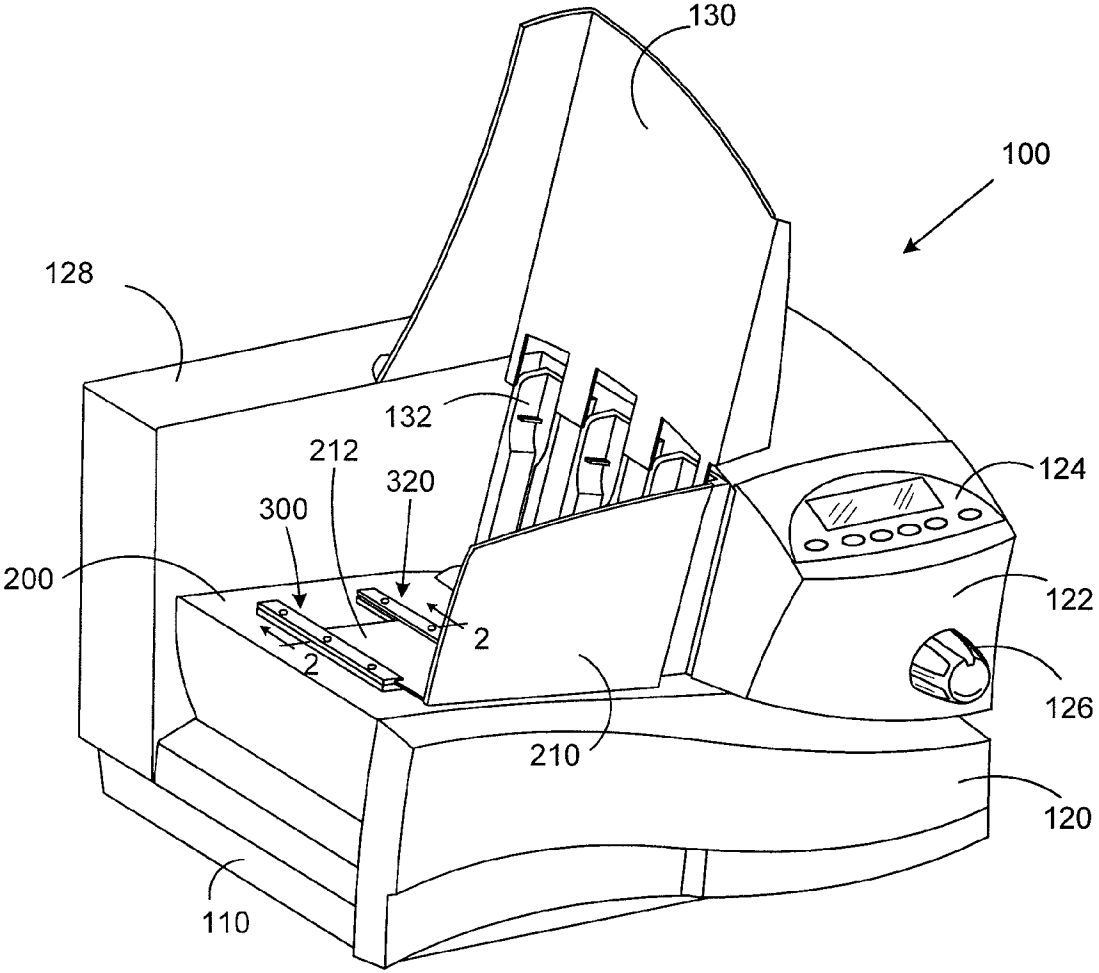
FIG. 1 is a perspective view of a modified envelope printer having an improved side guide mount clamp system according to an illustrative embodiment of the present application.

A media support mechanism having a flexible biased mount is described. In an illustrative embodiment, the media support mechanism is an adjustable side guide that is mounted in a biased clamp. As described, multiple side guides having differing length mounting portions may be used to accommodate a wide range of media sizes. The biased clamp includes opposing clamps each having two portions with at least one biased toward the other portion. One or more of the clamp portions may include a tapered guide surface to facilitate insertion of a media side guide. In an illustrative embodiment, each opposing clamp includes a top portion and a bottom portion fixed to the printer deck by a shoulder bolt wherein the bottom portion engages a coil spring and is spring biased from the deck toward the top portion of the clamp to engage the mounting portion of the side guide. The coil springs are selected to apply sufficient force to facilitate holding the side guide sufficiently in place during operation and to also allow a reasonable force to adjust the width of the side guide.

In an alternative embodiment, several coil springs are used in each clamp such as mounted using three shoulder bolts and a coil spring for each. In one embodiment, the three coil springs each apply the same force. However, in alternative embodiments, at least one of the coil springs applies a different force. In one example, each of the three coil springs is selected so that a higher force is applied for each spring from the front (control panel side) to the rear of the printer. In another example, the two end shoulder bolts have associated coil springs and the center shoulder bolt does not.

In another illustrative embodiment, the at least one biased clamp portion is biased by a leaf spring. Similarly, multiple leaf springs may be used as described above and may provide different force as described above with reference to the respective coil spring illustrative embodiment. In yet another illustrative embodiment, the at least one biased clamp portion is biased by one or more Belleville washers. Similarly, multiple Belleville washers may be used as described above and each may provide a different force as described above with reference to the respective coil spring illustrative embodiment. In one illustrative embodiment, the side guide comprises powder coated steel and the clamp portions comprise Polyoxymethylene plastic.

DETAILED DESCRIPTION

The present invention is described in the context of illustrative embodiments directed to an envelope printer having a media side guide that may be frequently adjusted or replaced to accommodate a wide variety of media sizes to allow efficient reconfiguration between batch print jobs. In the described embodiments, the address printer includes a feed tray mounted above the printer deck that may be adjusted side-to-side to accommodate media stacks of many media sizes. One or more side guides engage a side guide mount to provide side support for the media stack on the feed tray.

Referring to FIG. 1, a perspective view of a modified envelope printer 100 having an improved compression spring-loaded side guide mount clamp system 300, 320 according to an illustrative embodiment of the present application is shown. In prior printers, fixed side guide mounts were used.

Certain users may have been unhappy with the operation of such fixed side guide mounts. Manufacturing tolerances of the side guide and the fixed mount would affect the operation of the prior printer side guides. For example, if the side guide was a powder coated steel painted to match the printer 100, the paint thickness could vary. Additionally a fixed guide mount slot would be built to certain manufacturing tolerances. It has been determined that due to such manufacturing tolerances, the side guides might be too tight or too loose in the mount. If the force required to move the registration side guide in or out as needed or to replace it varied, it would be perceived as too high or too low a force required to move the guide. If the force required to move the side guide was too low, during operation the envelopes in the media stack would press against the guide and move the guide leading to media stack skew and jam conditions. If the mounts were too tight and the force required to move the guide was too high, the side guides would not move smoothly. A user might then tend to push the side guide with too much force and the guide would jump forward too much causing improper side guide spacing and jam conditions.

Figure 4:
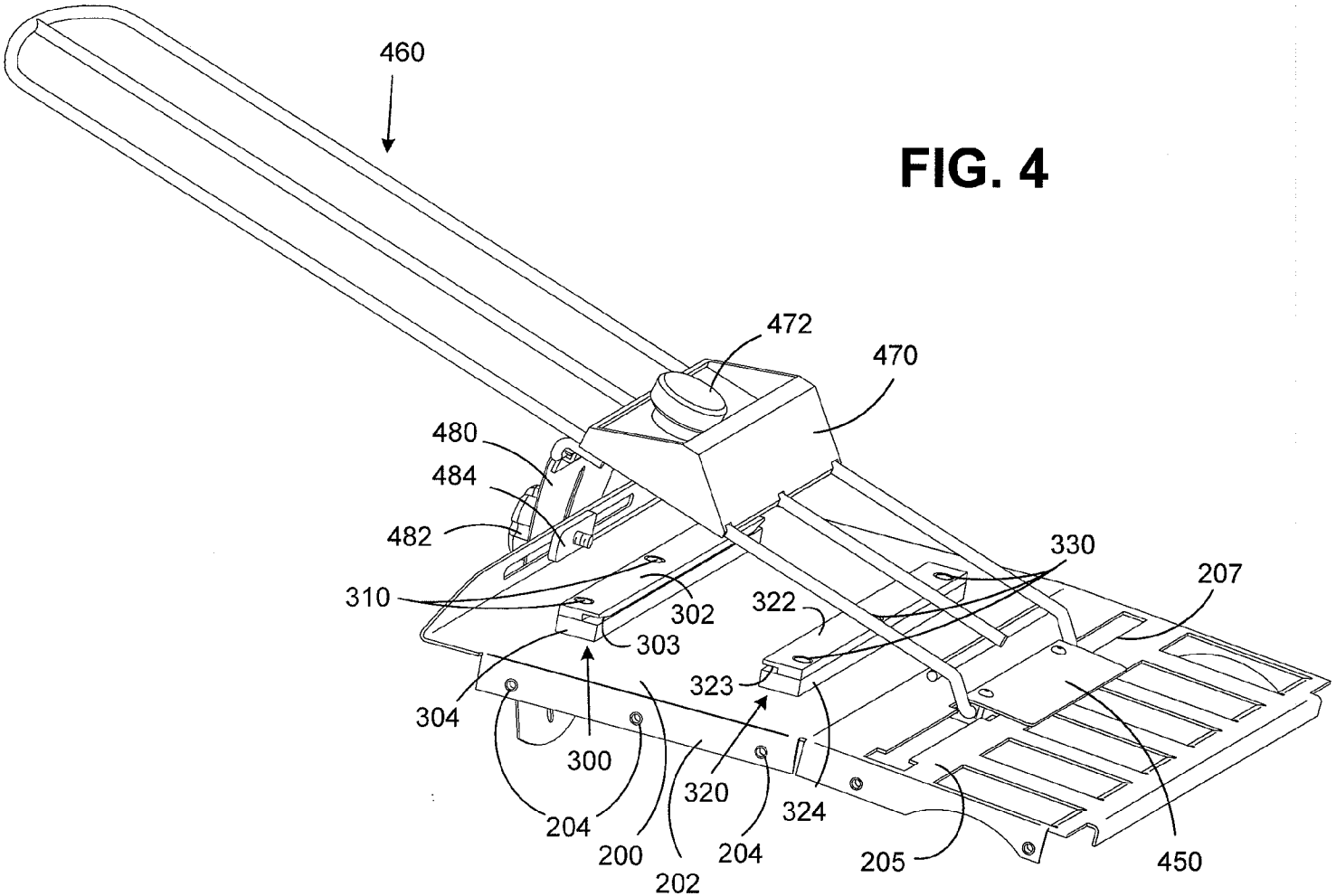
FIG. 4 is a perspective view of a modified envelope deck with feed tray of the modified envelope printer of FIG. 1 according to an illustrative embodiment of the present application.

In FIG. 1, the feed tray is omitted for clarity and a representative feed tray is shown in FIG. 4. Here, the illustrative embodiment is described as a modified envelope printer (a modification of the DA75S ADDRESSRIGHT envelope printer available from Pitney Bowes Inc. of Stamford, Conn.). Address printer 100 includes a base 110 with a lower front cover 120 and an upper front cover 122. The address printer 100 includes a rear support and cover 128 and an attached bin extender 130. The bin extender 130 provides support for tall stacks of media. Adjustable supports toward the front of the media stack are known as H-block separators 132. The H-block separators 132 adjust to the thickness of the media being fed into the printer 100. The gap between the H-block separator 132 fingers and the feed rollers are preferably adjusted so that only a single media piece is fed through the printer at one time. The printer 100 includes a media thickness adjustment knob 126 for adjusting the print head height to accommodate varying media thicknesses. The printer 100 also includes a user interface 124 and local or network connections (not shown) for use with a co-located or remote processor such as a DELL VOSTRO 220 PC computer (not shown).

A registration side guide 210 includes a side guide mounting portion 212 that is mounted perpendicular to the main side guide portion 210, wherein the mounting portion 212 engages the biased side guide mount clamp system 300, 320. The side guide mount clamp system 300, 320 is described in more detail below. For the address printer 100 described herein, the deck 200 does not directly support the media. Positioned above the deck 200 and the registration side guide mount clamps 300, 320 is an input guide feed tray that is typically a metal wire frame that supports the media stack and that adjusts feed angle on an arc (input guide feed tray and adjusting hardware are not shown for clarity in depicting the side guide mount). The feed ramp (not shown) is attached to the front input side of the deck away from the input roller nips using a lock knob (not shown). The feed ramp adds an adjustable slope to the media stack to help feeding. A user will lower the feed ramp and attached input guide until the top of the bottom piece in the stack reaches the middle of the ramp and then secure the ramp with the lock knob. The input guide feed tray metal wire frame typically includes a slide and slide lock knob that adjusts along the length of the input guide feed tray wire frame (not shown) to adjust the feed angle of the bottom media pieces on the media stack to accommodate the weight of the media being processed. The slide is moved to center it under the stack before the knob is tightened.

Figure 2:
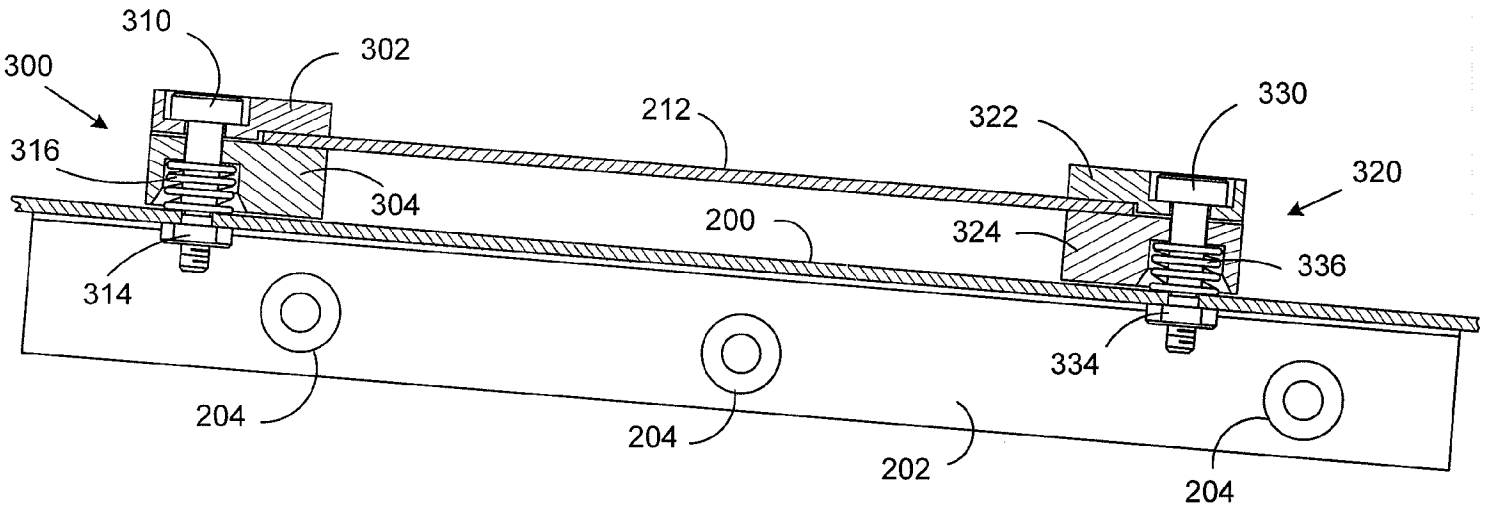
FIG. 2 is a sectional view along line 2-2 of FIG. 1 showing a sectional view of improved side guide mount clamps according to an illustrative embodiment of the present application.

Referring to FIG. 2, a sectional view along line 2-2 of FIG. 1 depicting a sectional view of the improved side guide mount clamps according to an illustrative embodiment of the present application is shown. A media support mechanism having a flexible biased mount is described. In an illustrative embodiment, the media support mechanism is an adjustable side guide that is mounted in a biased clamp. As described, multiple side guides having differing length mounting portions may be used to accommodate a wide range of media sizes. The biased clamp includes opposing clamps each having two portions with at least one biased toward the other portion. One or more of the clamp portions may include a tapered guide surface to facilitate insertion of a media side guide. In an illustrative embodiment, each opposing clamp includes a top portion and a bottom portion fixed to the printer deck by a shoulder bolt wherein the bottom portion engages a coil spring and is spring biased from the deck toward the top portion of the clamp to engage the mounting portion of the side guide. The coil springs are selected to apply sufficient force to facilitate holding the side guide sufficiently in place during operation and to also allow a reasonable force to adjust the width of the side guide.

Printer 100 includes a deck 200 supported by deck mounting flange 202 having PEM NUT threaded holes for mounting in the base 110. The registration side guide 210 includes side guide mounting portion 212 that engages biased clamp system 300, 320. The biased clamp 300 includes three shoulder bolts 310 secured to PEM NUT nuts 314 press-fit into the deck 200. The clamp 300 includes an upper clamp portion 302 and a lower clamp portion 304 that is biased upward by compression spring 316. The opposing biased clamp 320 includes three shoulder bolts 330 secured to PEM NUT nuts 334 press-fit into the deck 200. The clamp 320 includes an upper clamp portion 322 and a lower clamp portion 324 that is biased upward by compression spring 336.

In this illustrative embodiment, the polyoxymethylene plastic used in fabricating the clamp portions 302, 304, 322, 324 is DELRIN brand plastic available from E. I. du Pont de Nemours and Company of Wilmington, Del. DELRIN is a lightweight, low-friction, and wear-resistant thermoplastic with good physical and processing properties. In an alternative embodiment, the clamp portions comprise powder coated steel, stainless steel or aluminum. The side guide 210 comprises powder coated steel and includes a side guide mounting portion 212. In an alternative embodiment, the side guide comprises DELRIN, stainless steel or aluminum.

In this illustrative embodiment, the deck fasteners 314, 334 are PEM NUT brand threaded nuts mounted into the deck 200 and that are available from Penn Engineering & Manufacturing Corp. of Danboro, Pa. In the illustrative embodiment, clamp mount 300 includes three shoulder bolts 310 spaced along the clamp with the associated springs 316 and PEM nuts 314. In this embodiment, the three coil springs each apply the same force of approximately 6 lbs. of force against the typical side guide mounting portion 212. However, in an alternative, the spring force may be in the range of 2-12 lbs. of force. In another example, the two end shoulder bolts in each clamp 300, 320 have associated coil springs, but the center shoulder bolt does not.

In alternative embodiments, at least one of the coil springs applies a different force. In one example, each of the three coil springs is selected so that a higher force is applied for each spring from the front (control panel side) to the rear of the printer. For example, the front spring applies 4 lbs., the middle 8 lbs. and the end 12 lbs. In another illustrative embodiment, the at least one biased clamp portion is biased by a leaf spring. Similarly, multiple leaf springs may be used as described above and may each provide different force as described above with reference to the respective coil spring illustrative embodiment. In yet another illustrative embodiment, the at least one biased clamp portion is biased by one or more Belleville washers. Similarly, multiple Belleville washers may be used as described above and may each provide different force as described above with reference to the respective coil spring illustrative embodiment.

Figure 3:
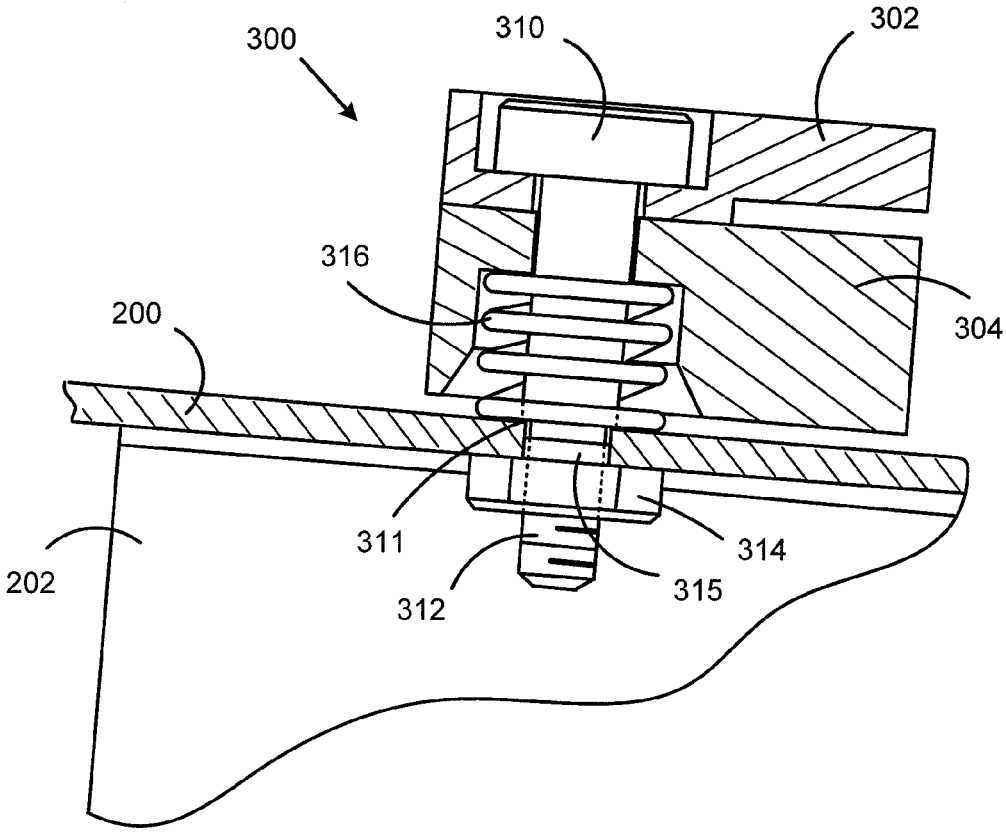
FIG. 3 is an exploded view of a portion of FIG. 2 depicting the left improved side guide mount according to an illustrative embodiment of the present application.

Referring to FIG. 3, an exploded view of a portion of FIG. 2 depicting the left improved side guide mount according to an illustrative embodiment of the present application is shown. The improved side guide mount clamp 300 includes upper 302 and lower 304 portions of each side mount clamp (300, 320) such that compression springs 316 bias the lower portion 304 upward to provide a preload force in the mount gap to receive the side guide support mounting portion 212. The printer 100 is provided with multiple side guides having differing length side guide mounting portions 212 to facilitate supporting narrow to wide media stacks. The spring biased system provides a consistent force and feel for the customer across multiple side guides that might have different paint thicknesses. Furthermore, the preload force may be changed by adding or exchanging compression springs as desired. If the preload force provides too loose or too tight a fit, the springs may be replaced.

Printer 100 includes a deck 200 supported by deck mounting flange 202. The registration side guide 210 includes side guide mounting portion 212 that engages biased clamp system 300. The biased clamp 300 includes three shoulder bolts 310 having threads 312 for securing the bolts 310 to PEM NUT nuts 314 press-fit into the deck 200 by PEM NUT shoulder 315. The clamp 300 includes an upper clamp portion 302 and a lower clamp portion 304 that is biased upward by compression spring 316. For clarity, the side guide mounting support 212 is not shown in the clamp gap between upper clamp portion 302 and lower clamp portion 304. Here, mounting means comprise shoulder bolts 310 and PEM NUT nuts 314. However, alternative mounting arrangements allowing slidable engagement with clamp portions may be utilized.

The portions of the clamps 302, 304 have associated recesses and channels to accommodate the shoulder bolt and the lower portions 304 have receiving recesses for the associated top portions of biasing means springs 316 with the bottom portion of springs 316 adjacent to the deck 200. At least the top surfaces 302 include a recess to receive the side guide mounting portion 212 and a tapered guide surface described below. The side guide receiving recess may alternatively be formed in both the upper 302 and lower 304 surfaces. Here, the biasing means include compression springs 316. Alternatively, biasing means may include one or more leaf springs, one or more Belleville washers or a combination of compression springs, Belleville washers and/or leaf springs.

Referring to FIG. 4, a perspective view of a modified envelope deck 200 with feed tray 460 of the modified envelope printer of FIG. 1 according to an illustrative embodiment of the present application is shown. In this view, the upper tapered guide surfaces 303, 323 are shown in the respective clamp upper portions 302, 322. In an alternative, each clamp portion 302, 304, 322, 324 includes a tapered guide surface. Each side guide mount clamp 300, 320 includes upper 302, 322 and lower 304, 324 portions and three shoulder bolts 310, 330. The printer 100 is shown with deck 200, flange 202 with mounting nuts 204 and a forward deck portion 205. Forward deck portion 205 includes slot 207 for receiving slidably engaged feed tray mount 450.

Deck 200 does not directly support the media stack. Instead, an input guide feed tray 460 is typically a metal wire frame that supports the media stack. The input guide feed tray 460 includes a media stack slide 470 and lock knob 472 to add an adjustable slope to the media stack using the face of slide 470. The feed tray is supported by a ramp 480 engaging a vertical slot to adjust the angle of the feed tray 460 with a lock knob 482 engaging nut 484 in that vertical slot. The lock knob 482 also engages a horizontal slot to allow the feed tray 460 to be adjusted along with mount 450 in slot 207 to facilitate support of narrow or wide media stacks.

In summary, certain illustrative embodiments of the present application disclose an invention that at least provides a novel mounting arrangement for a printer with side guides used to support a wide variety of media sizes and that permit rapid adjustment or replacement of the side guides.

Although the invention has been described with respect to particular illustrative embodiments thereof, it will be understood by those skilled in the art that the foregoing and various other changes, omissions and deviations in the form and detail thereof may be made without departing from the scope of this invention.

What is claimed is:

1. A printer having a biased guide mounting mechanism comprising;

an adjustable media support guide having a first portion for supporting media in the printer and a second portion for engaging the biased guide mounting mechanism;

a support member for supporting the biased guide mounting mechanism for engaging the media support guide, the biased mounting mechanism including a first biased clamp and a second biased clamp, wherein, the first biased clamp includes a first portion and a second portion biased toward the first portion for engaging the second portion of the media support guide permitting slidable engagement, and the second biased clamp includes a first portion and a second portion biased toward the first portion for engaging the second portion of the media support guide permitting slidable engagement.

2. The printer according to claim 1 wherein, the first biased clamp includes at least one compression spring to bias the second portion of the first biased clamp toward the first portion of the first biased clamp, and the second biased clamp includes at least one compression spring to bias the second portion of the second biased clamp toward the first portion of the second biased clamp.

3. The printer according to claim 2 wherein, the at least one compression spring of the first biased clamp asserts approximately 2-12 pounds of force, and the at least one compression spring of the second biased clamp asserts approximately 2-12 pounds of force.

4. The printer according to claim 1 wherein, the first biased clamp includes at least two shoulder bolts for securing the first biased clamp to the support member, and the second biased clamp includes at least two shoulder bolts for securing the second biased clamp to the support member.

5. The printer according to claim 1 wherein, the first biased clamp includes mounting means for securing the first biased clamp to the support member, and the second biased clamp includes mounting means for securing the first biased clamp to the support member, the first biased clamp includes biasing means to bias the second portion of the first biased clamp toward the first portion of the first biased clamp, and the second biased clamp includes biasing means to bias the second portion of the second biased clamp toward the first portion of the second biased clamp.

6. The printer according to claim 3 wherein, the at least one compression spring of the first biased clamp includes at least two compression springs that each assert a different force of approximately 2-12 pounds of force, with a difference of at least approximately one pound of force, and the at least one compression spring of the second biased clamp includes at least two compression springs that each assert a different force of approximately 2-12 pounds of force, with a difference of at least approximately one pound of force.

7. The printer according to claim 1 wherein, the first portion of the first biased clamp includes at least one tapered guide surface, and the first portion of the second biased clamp includes at least one tapered guide surface.

8. The printer according to claim 1 wherein, the media support guide comprises powder coated steel, and the first and second portion of the first biased clamp and the first and second portion of the second biased clamp comprise polyoxymethylene plastic.

9. The printer according to claim 8 wherein, the first portion of the media support guide and the second portion of the media support guide are arranged in approximately perpendicular planes.

10. The printer according to claim 1 wherein, the first biased clamp includes at least three fasteners arranged inline along the first biased clamp for securing the first biased clamp to the support member with an inner fastener and an outer fastener supporting a spring, and the second biased clamp includes at least three fasteners arranged inline along the first biased clamp for securing the first biased clamp to the support member with an inner fastener and an outer fastener supporting a spring.

11. The printer according to claim 1 wherein, the first biased clamp is in the same plane and opposed to the second biased clamp, the first portion of the first biased clamp is disposed above the second portion of the first biased clamp and includes at least one tapered guide surface and at least one spring to bias the second portion of the first biased clamp toward the first portion of the first biased clamp, and the first portion of the second biased clamp is disposed above the second portion of the second biased clamp and includes at least one tapered guide surface and at least one spring to bias the second portion of the second biased clamp toward the first portion of the second biased clamp.

12. A printer having a biased guide mounting mechanism comprising;

a media support guide having a first portion for supporting media in the printer and a second portion for engaging the biased guide mounting mechanism;

a support member for supporting the biased guide mounting mechanism for engaging the media support guide, the biased mounting mechanism including at least one biased clamp, wherein, the at least one biased clamp includes a first portion and a second portion biased toward the first portion for engaging the second portion of the media support guide permitting slidable engagement.

13. The printer according to claim 12 wherein, the at least one biased clamp includes at least one compression spring to bias the second portion of the biased clamp toward the first portion of the biased clamp, and the second biased clamp includes at least one compression spring to bias the second portion of the second biased clamp toward the first portion of the second biased clamp.

14. The printer according to claim 13 wherein, the at least one compression spring of the biased clamp asserts approximately 2-12 pounds of force.

* * * * *